US010419840B2

(12) United States Patent
Lu et al.

(10) Patent No.: US 10,419,840 B2
(45) Date of Patent: Sep. 17, 2019

(54) ANNULAR HEADPHONE

(71) Applicants: DEXIN ELECTRONIC LTD., Dongguan, Guangdong (CN); DEXIN CORPORATION, New Taipei (TW)

(72) Inventors: Ho-Lung Lu, New Taipei (TW); Yi-Shun Chen, New Taipei (TW)

(73) Assignees: DEXIN ELECTRIONIC LTD., Dongguan, Guangdong (CN); DEXIN CORPORATION, New Taipei (TW)

( * ) Notice: Subject to any disclaimer, the term of this patent is extended or adjusted under 35 U.S.C. 154(b) by 0 days.

(21) Appl. No.: 15/867,296

(22) Filed: Jan. 10, 2018

(65) Prior Publication Data

US 2019/0215592 A1 Jul. 11, 2019

(51) Int. Cl.
*H04R 1/10* (2006.01)

(52) U.S. Cl.
CPC ..... *H04R 1/105* (2013.01); *H04R 1/1008* (2013.01); *H04R 1/1066* (2013.01)

(58) Field of Classification Search
CPC .... H04R 1/105; H04R 1/1008; H04R 1/1066; H04R 1/10; H04R 1/1016; H04R 1/1058; H04R 1/1075; H04R 2205/024; H04R 2201/103; H04R 2205/022; H04R 2420/07; H04R 5/033; H04R 5/027; H04R 5/0335
See application file for complete search history.

(56) References Cited

U.S. PATENT DOCUMENTS

| | | | | | |
|---|---|---|---|---|---|
| 2,361,963 | A * | 11/1944 | Rosenblatt | A61F 11/08 | 137/510 |
| 2,609,544 | A * | 9/1952 | Berg | A61F 11/06 | 2/209 |
| 4,864,619 | A * | 9/1989 | Spates | H04R 1/10 | 381/309 |
| 5,438,698 | A * | 8/1995 | Burton | H01Q 1/276 | 2/209.13 |
| 5,881,390 | A * | 3/1999 | Young | A41D 20/00 | 2/209.13 |
| 9,118,996 | B1 * | 8/2015 | Garcia | H04R 1/028 | |
| 9,143,854 | B2 * | 9/2015 | Alao | H04R 1/105 | |
| D747,696 | S * | 1/2016 | Hardi | D14/205 | |
| 2006/0185062 | A1 * | 8/2006 | Peng | H04R 5/0335 | 2/209.13 |
| 2008/0044052 | A1 * | 2/2008 | Whipple | A42B 1/245 | 381/376 |

(Continued)

FOREIGN PATENT DOCUMENTS

WO WO-2010015030 A1 * 2/2010 ..... A41D 20/00

*Primary Examiner* — Oyesola C Ojo
(74) *Attorney, Agent, or Firm* — Li & Cai Intellectual Property (USA) Office

(57) ABSTRACT

An annular headphone includes a pair of speaker modules and a pair of wearing headbands. Each speaker module has a housing, an electroacoustic transducer disposed in the housing and a pair of joining portions. The pair of joining portions are oppositely formed on the housing. Each wearing headband has two ends which are respectively formed with a fixing piece. The two fixing pieces of each wearing headband are dismountably connected to one of the joining portions of each speaker module. The pair of speaker modules are arranged oppositely and disposed between the pair of the wearing headbands, so as to form an annular structure.

15 Claims, 8 Drawing Sheets

(56) References Cited

U.S. PATENT DOCUMENTS

| | | | | |
|---|---|---|---|---|
| 2008/0144872 | A1* | 6/2008 | Phillips | H04R 5/0335 381/333 |
| 2008/0181429 | A1* | 7/2008 | Fried | A42B 1/245 381/87 |
| 2013/0039524 | A1* | 2/2013 | Jones | H04R 5/033 381/378 |
| 2014/0321661 | A1* | 10/2014 | Alao | H04R 1/105 381/74 |
| 2014/0328508 | A1* | 11/2014 | Jacks | H04R 1/1008 381/376 |
| 2016/0044981 | A1* | 2/2016 | Frank | A42B 1/22 2/422 |

* cited by examiner

ANNULAR HEADPHONE

BACKGROUND OF THE INVENTION

1. Field of the Invention

The present disclosure is related to an annular headphone. In particular, the present disclosure relates to a ring-type headphone which can be worn on a user's head to listen sounds, and has two speaker modules combined by two wearing headbands to form an annular structure.

2. Description of Related Art

The current earmuff headphone has a reverse-U manner and is usually worn on a user's head, and the headphone has two speaker modules which can respectively retain on the user's ears through a clamping force. A headband, which is connected to the two speaker modules, is usually non-detachable from the headphone. In common usage, the headphone is prone to affect a user's hairstyle, and is not able to match the user's clothing collocation.

SUMMARY OF THE INVENTION

One of the objectives of the present disclosure is to provide an annular headphone which is worn on a user's head in a surrounding manner like a floral headband to avoid affecting the user's hairstyle.

Another of the objectives of the present disclosure is to provide an annular headphone of which the wearing headband connected with two earmuff-type speaker modules is replaceable, so that an appearance of the annular headphone can be changed for matching a user's different hairstyles or clothing.

In order to achieve the above objectives, according to one exemplary embodiment of the present disclosure, an annular headphone includes a pair of speaker modules and a pair of wearing headbands. Each of the speaker modules has a housing, an electroacoustic transducer disposed in the housing, and a pair of joining portions. The pair of joining portions are oppositely formed on the housing. Each of the wearing headbands has two ends, and each end of the wearing headband has a fixing piece. The two fixing pieces of each of the wearing headbands are dismountably connected with one of the joining portions of each of the speaker modules. The pair of speaker modules are oppositely arranged between the pair of the wearing headbands to form an annular structure.

Thus, the present disclosure has the advantages as follows. The annular headphone of the present disclosure uses two wearing headbands to connect two speaker modules, so as to form an annular structure. A user can put on the annular headphone like putting on a headband or a headscarf without affecting the user's hairstyle. In addition, the wearing headband of the annular headphone of the present disclosure is easy to dismount, thereby contributing to changing or washing the wearing headband for matching a user's different hairstyles or clothes, so as to create a personal style.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

First Embodiment

Figure 1:
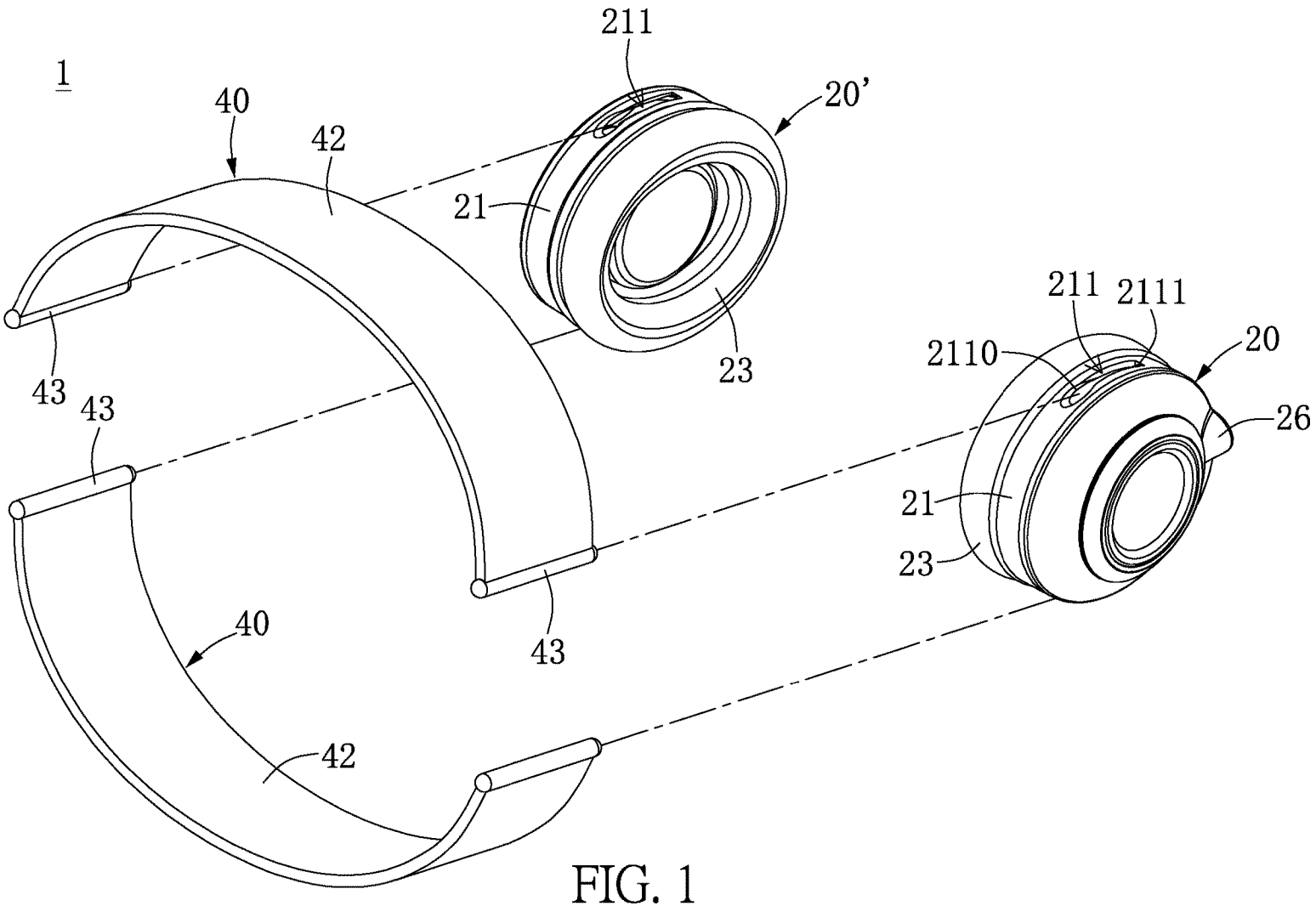
FIG. 1 is an exploded perspective view of an annular headphone according to the present disclosure.
Figure 2:
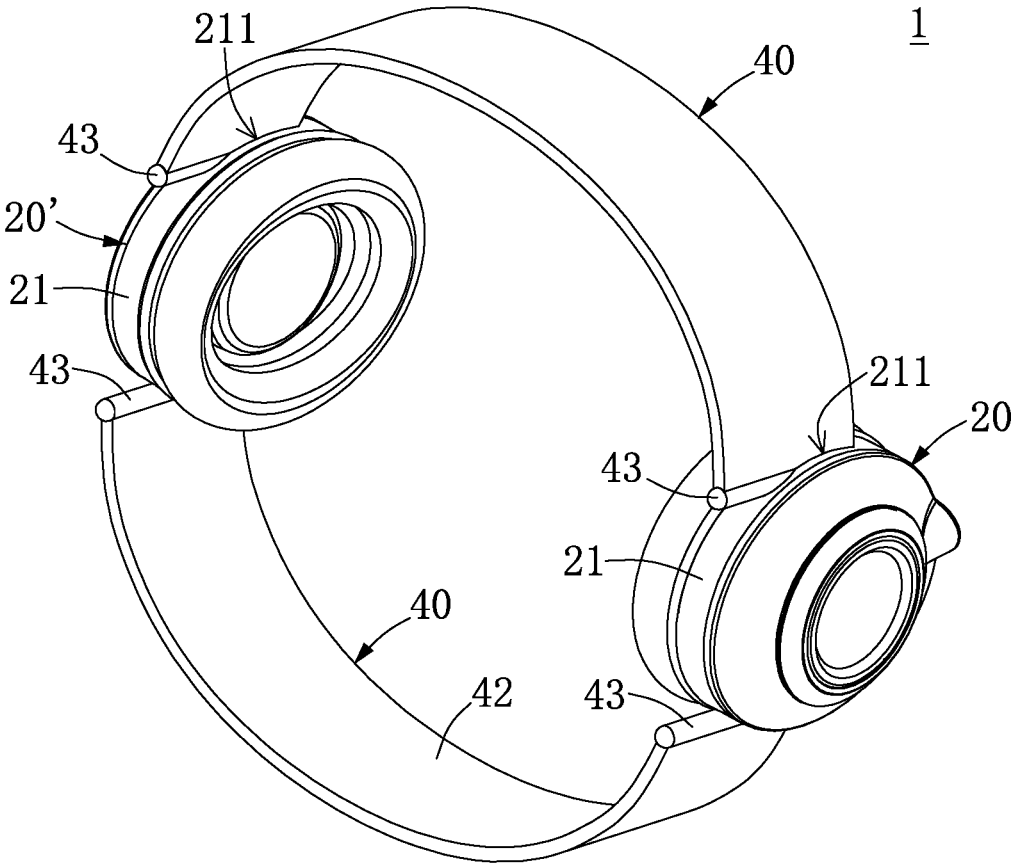
FIG. 2 is an assembled perspective view of the annular headphone according to the present disclosure.
Figure 3:
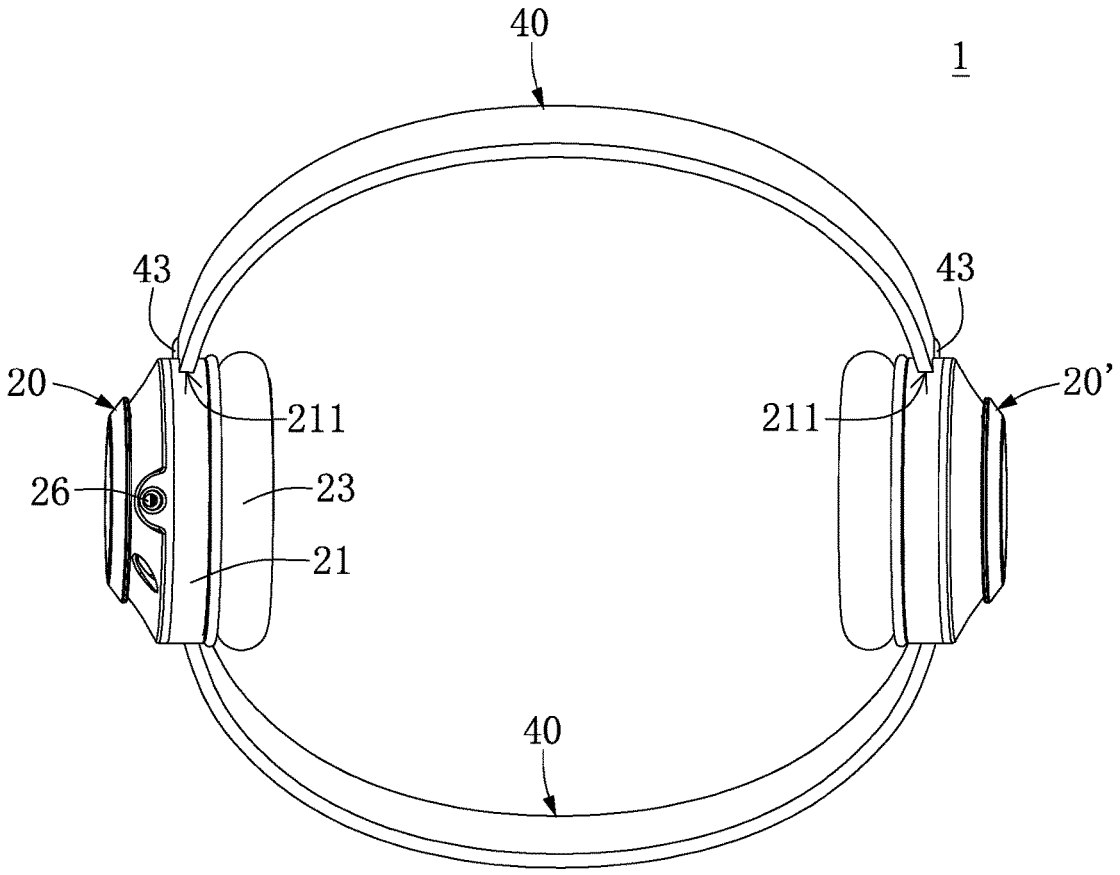
FIG. 3 is another assembled perspective view of the annular headphone according to the present disclosure.

Reference is made to FIG. 1 to FIG. 3. The present disclosure provides an annular headphone 1, which includes a pair of speaker modules 20, 20', and a pair of wearing headbands 40, 40. The pair of speaker modules 20, 20' are disposed between the pair of wearing headbands 40, 40. In other words, one end of each wearing headband 40 is connected to one side of one of the speaker modules 20, 20', and the other end of each wearing headband 40 is connected to the other one of the speaker modules 20, 20', so as to form a closed-type annular headphone 1. According to FIG. 1, the main difference between the right-side speaker module 20 and the left-side speaker module 20' is that the right-side speaker module 20 has a microphone socket 26 capable of connecting a microphone (not shown). The other structures of the pair of speaker modules 20, 20' are similar. The following description only illustrates the right-side speaker module 20 for sake of brevity.

Figure 4:
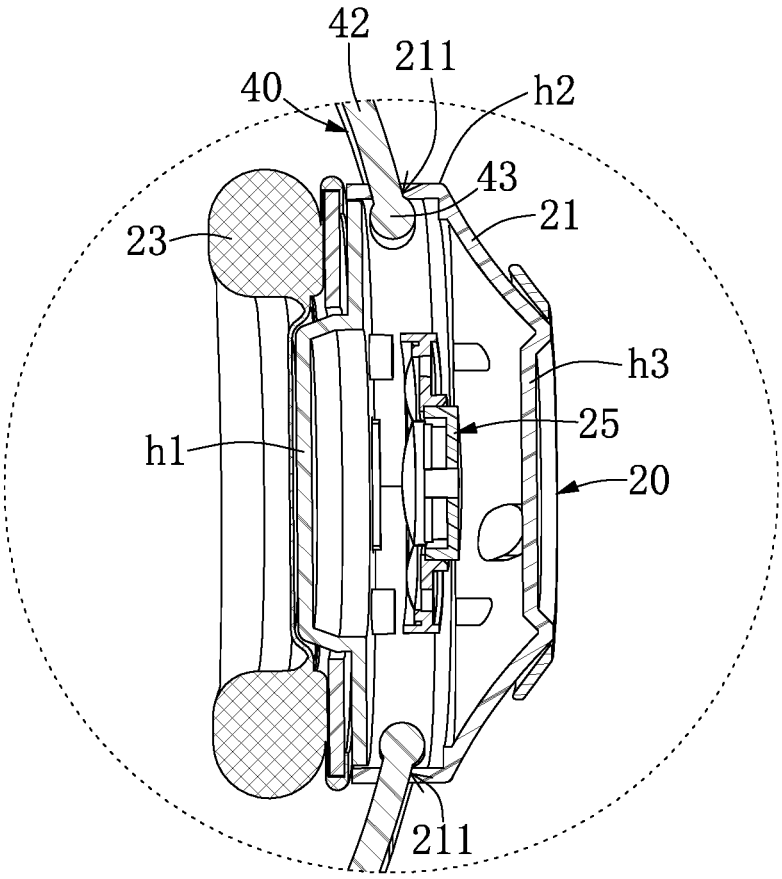
FIG. 4 is a partial cross-sectional view of the annular headphone according to the present disclosure.

Reference is made to FIG. 4. The speaker module 20 has a housing 21, an electroacoustic transducer 25 disposed in the housing 21, and a pair of joining portions 211. The pair of joining portions 211 are oppositely disposed on a periphery of the housing 21. The speaker module 20 has an ear cover 23 at one side thereof. The housing 21 has a shallow-dish-shaped inner shell h1, a bowl-shaped outer shell h3, and a circular shell h2 disposed between the inner shell h1 and the outer shell h3.

Reference is made to FIG. 1 to FIG. 2. The wearing headband 40 has a strip portion 42 and two fixing pieces 43. The wearing headband 40 has two ends, and each end has one fixing piece 43. The two fixing pieces 43 are formed at two ends of the strip portion 42. Preferably, the wearing headband 40 has resilience, which can be made of cloth or complex materials. In this embodiment, the fixing piece 43 has a diameter which is larger than a thickness of the strip portion 42. The two fixing pieces 43 of each wearing headband 40 are dismountably connected to one joining portion 211 of one speaker module 20. The pair of the speaker modules 20 are oppositely arranged between the pair of the wearing headbands 40 so as to form an annular structure.

In this embodiment, the joining portion 211 is formed in the housing 21 in a concave or hollow manner along a tangential direction on a surface of the housing 21. The fixing piece 43 of the wearing headband 40 is in a rod shape, or it can be an iso-diametrical shape or a cone shape. The fixing piece 43 is engaged and wedged in the joining portion 211 along the tangential direction.

Reference is made to FIG. 1. In detail, the speaker module 20 has two joining portions 211 which are substantially parallel to each other and formed on the circular shell h2 of the housing 21 oppositely. In this embodiment, the joining portion 211 is an elongated open groove, like a match stick, and has a head hole 2110 and a longitudinal slot 2111. In another view, a projected shape of the joining portion 211 along a tangential direction of the housing 21 is substantially matched with a profile of the fixing piece 43. A diameter of the head hole 2110 is substantially equal to a diameter of the fixing piece 43. A width of the longitudinal slot 2111 is smaller than the diameter of the head hole 2110. A thickness of the strip portion 42 is smaller than or substantially equal to the width of the longitudinal slot 2111. The fixing piece 43 is inserted into the joining portion 211 from the head hole 2110, and the strip portion 42 is inserted into the longitudinal slot 2111.

In addition, a length of the joining portion 211 is smaller than a diameter of the housing 21. After the fixing piece 43 of the wearing headband 40 is assembled to the joining portion 211 of the speaker module 20, one end of the fixing piece 43 is hidden in the housing 21 and the other end of the fixing piece 43 is exposed outside the housing 21.

Figure 5:
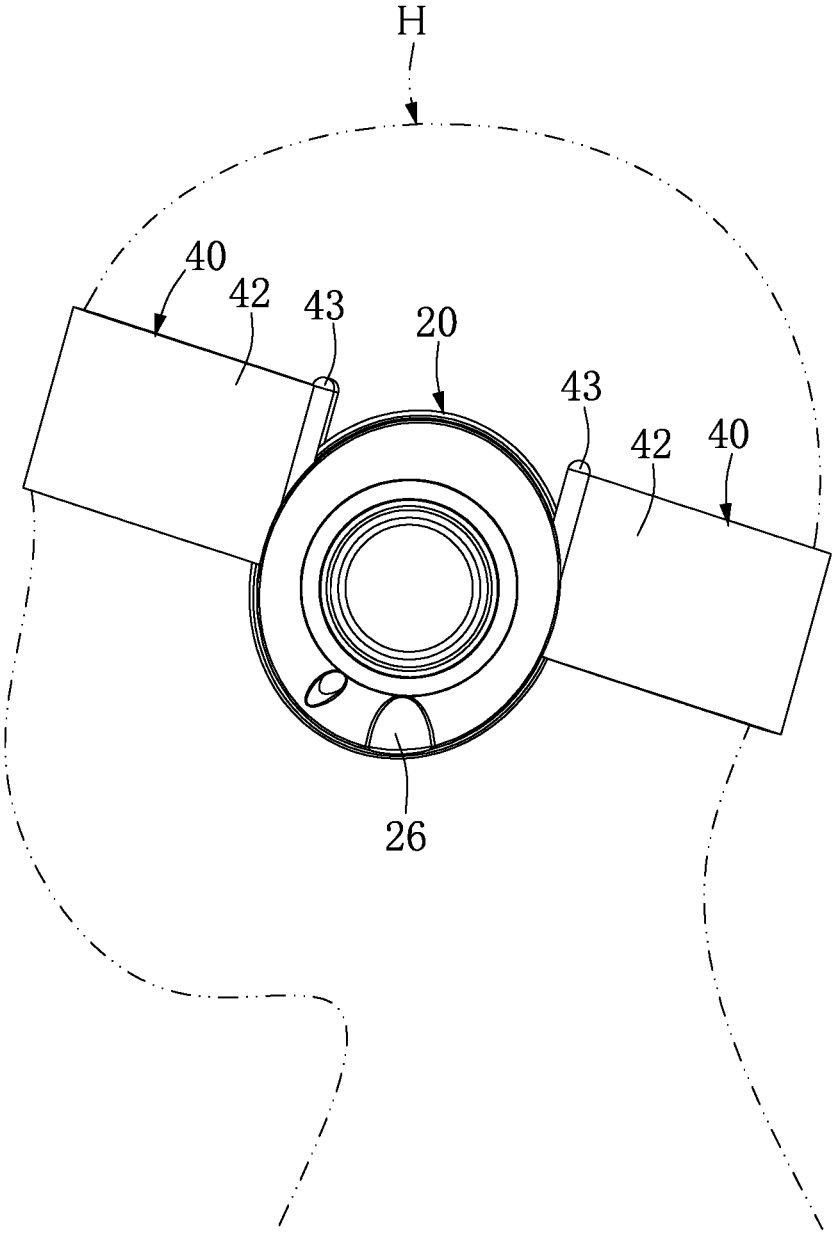
FIG. 5 is a perspective view showing the annular headphone in a usage condition according to the present disclosure.

Reference is made to FIG. 5, which is a perspective view of the annular headphone of the present disclosure being put on a user's head H. The present disclosure can further have an identified mark on the wearing headband 40. The wearing headband 40 is replaceable, which can be dismounted from the speaker modules 20, 20', and is washable. Therefore, the user can change the wearing headbands 40 for matching different hairstyles or clothes, so as to create a personal style.

Second Embodiment

Figure 6:
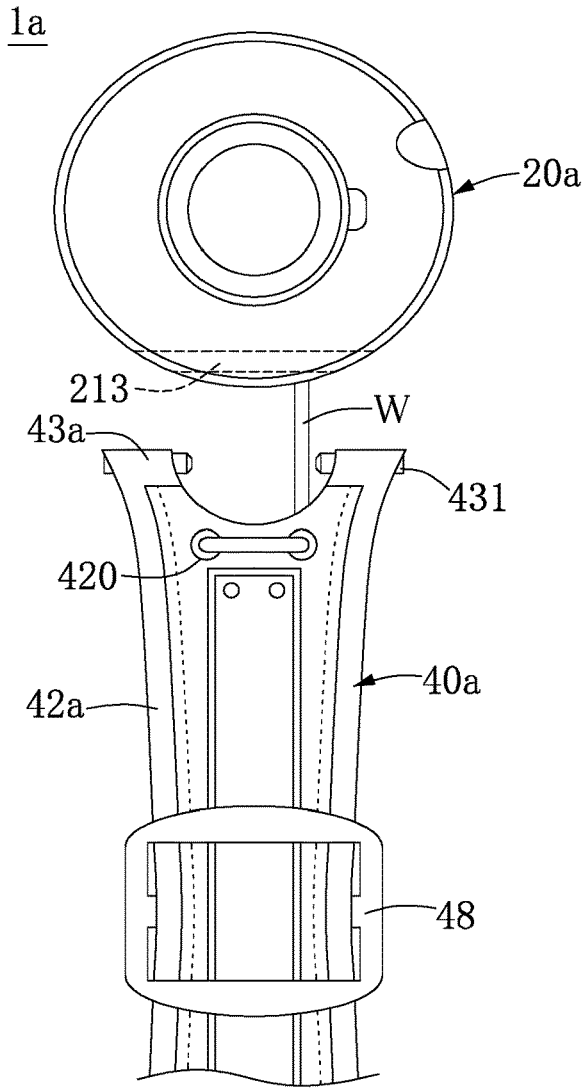
FIG. 6 is a partial exploded perspective view of the annular headphone of a second embodiment according to the present disclosure.
Figure 7:
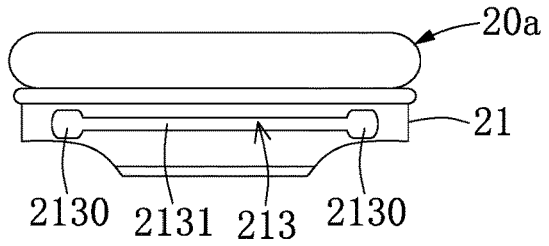
FIG. 7 is a side view of the annular headphone of the second embodiment according to the present disclosure.

Reference is made to FIG. 6 and FIG. 7, which are partial views of the annular headphone of a second embodiment according to the present disclosure. This embodiment provides an annular headphone 1*a*, which includes a wearing headband 40*a* having an adjustable-length element 48. The length of the wearing headband 40*a* is adjustable. The wearing headband 40*a* is substantially in a B shape, but it is not limited thereto.

The wearing headband 40*a* of the annular headphone 1 a has a strip portion 42*a* which has a cable fixer 420 for fixing a cable W. The cable W is used to connect the pair of speaker modules 20*a*. The cable W is detachably assembled in the wearing headband 40*a*. The cable fixer 420 can be a hole, or further form a channel in the wearing headband 40*a*. For example, the channel can be formed in the strip portion 42*a*.

In addition, the joining portion 213 of this embodiment is formed concavely in the housing 20 along the tangential direction on a periphery of the housing 21. Each joining portion 213 has a pair of joining openings 2130 and a longitudinal slot 2131 communicating with the pair of joining openings 2130. The pair of joining openings 2130 are on the same straight line, or collinear. The fixing piece 43*a* has a pair of pins 431. The end of the wearing headband 40*a* is substantially U-shaped. The pair of pins 431 are on the same straight line and separated on the end of the wearing headband 40*a*.

Third Embodiment

Figure 8:
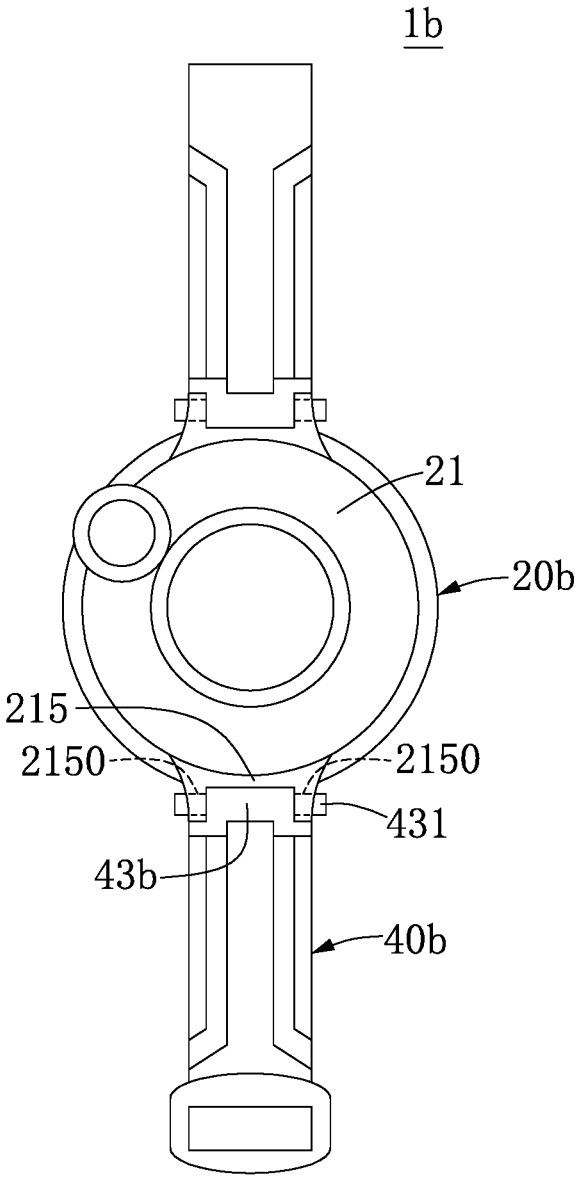
FIG. 8 is a side view of the annular headphone of a third embodiment according to the present disclosure.

Reference is made to FIG. 8. In this embodiment, the speaker module 20*b* of the annular headphone 1*b* has a protrusive joining portion 215. The joining portion 215 is protruded outside the speaker module 20*b*, and is substantially U-shaped. The joining portion 215 has two sides which are formed with a joining opening 2150, respectively. The fixing piece 43*b* of the wearing headband 40*b* has a pin 431, and the pin 431 passes through two sides of the joining portion 215.

Fourth Embodiment

Figure 9:
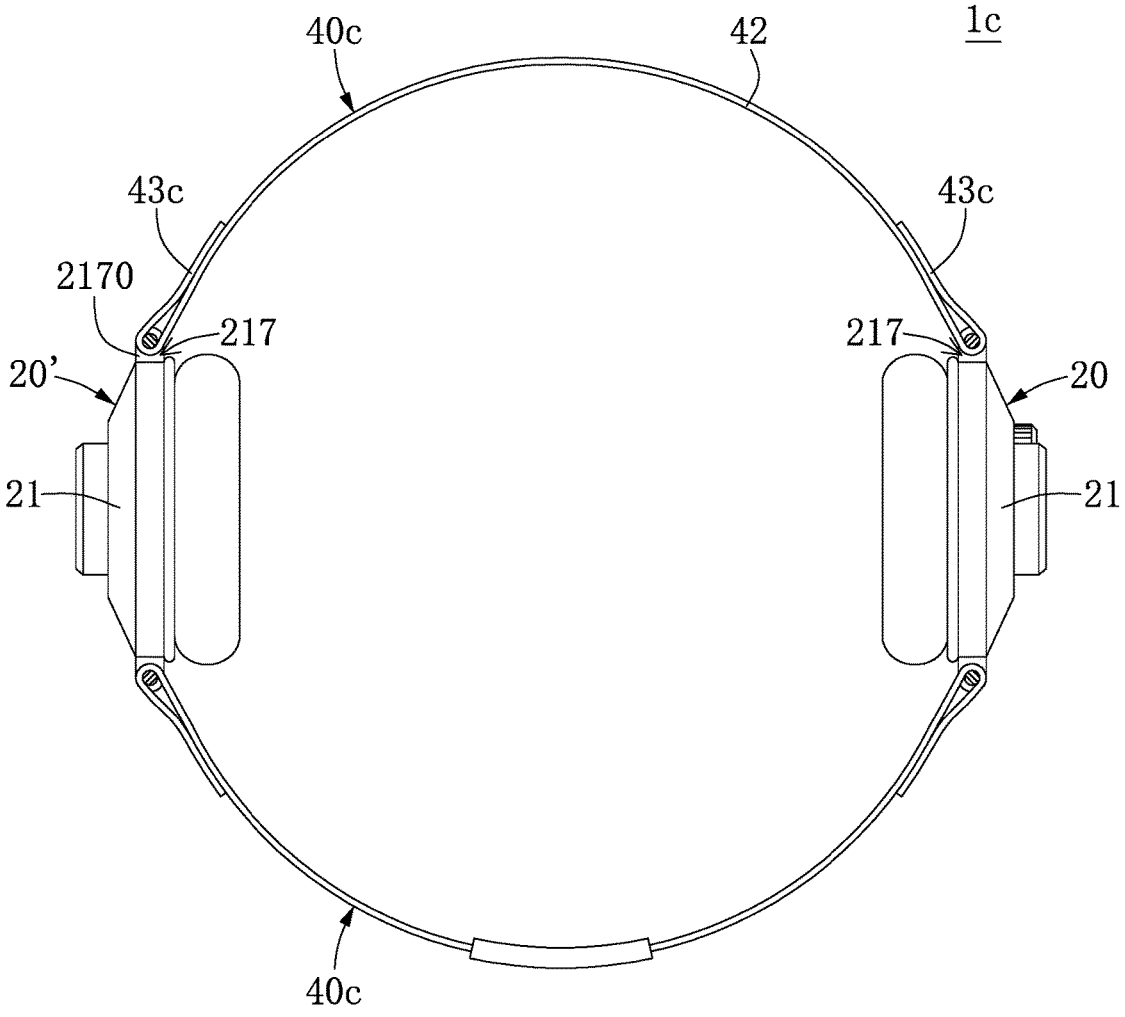
FIG. 9 is a top partial cross-sectional view of the annular headphone of a fourth embodiment according to the present disclosure.

Reference is made to FIG. 9. The annular headphone 1*c* of this embodiment has a pair of speaker modules 20, 20'. Each of the speaker modules 20, 20' has a joining portion 217 which is protruded outside the housing 21 and is formed with a through slot 2170. The fixing piece 43*c* of the wearing headband 40*c* is strip-shaped and passes through the through slot 2170 to connect the wearing headband 40*c*. An inner side of the fixing piece 43*c* of the wearing headband 40*c*, which passes through the through slot 2170, is formed with an attaching element, so as to be fixed to the joining portion 217 in a folded manner. For example, the attaching element can be a hook and loop fastener, (or called as touch fastener, Velcro tape). One inner side of the fixing piece 43*c* has loop structure, and the other inner side thereof has hook structure, so as to hook to each other. However, it is not limited thereto. The attaching element can be a buckle (not shown).

The present disclosure has features and functions that change a matching manner of headphone. The annular headphone of the present disclosure uses two wearing headbands to connect two speaker modules, so as to form an annular structure. The user can put on the annular headphone like putting on a headband or a headscarf without affecting the user's hairstyle. In addition, the wearing headband of the annular headphone of the present disclosure is easy to dismount, thereby contributing to changing or washing the wearing headband for matching a user's different hairstyles or clothes, so as to create a personal style.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An annular headphone, comprising:

a pair of speaker modules, each of the speaker modules having a housing, an electroacoustic transducer disposed in the housing, and a pair of joining portions, and the pair of joining portions being oppositely formed on the housing; and a pair of wearing headbands, each of the wearing headbands having two ends, each end of the wearing headband having a fixing piece, wherein the two fixing pieces of each of the wearing headbands are dismountably connected with one of the joining portions of each of the speaker modules, and the pair of speaker modules are oppositely arranged between the pair of the wearing headbands to form an annular structure;

wherein each of the joining portions is formed along a tangential direction on a periphery of the housing and is formed concavely in the housing; wherein each of the fixing pieces of the wearing headband is rod-shaped, and the fixing piece is engaged and wedged in the joining portion along the tangential direction.

2. The annular headphone as claimed in claim 1 wherein the pair of joining portions of each of the speaker modules are substantially parallel to each other.

3. The annular headphone as claimed in claim 1, wherein a length of the joining portion is smaller than a diameter of the housing; when the fixing piece of the wearing headband is assembled to the joining portion of the speaker module, one end of the fixing piece is hidden in the housing and the other end of the fixing piece is exposed outside the housing.

4. The annular headphone as claimed in claim 1, wherein the wearing headband has resilience.

5. The annular headphone as claimed in claim 1, wherein the wearing headband has an adjustable-length element used to adjust a length of the wearing headband.

6. The annular headphone as claimed in claim 1, wherein the wearing headband has a cable fixer to fixedly connect a cable of the pair of speaker modules, and the cable is dismountably assembled with the wearing headband.

7. An annular headphone, comprising:

a pair of speaker modules, each of the speaker modules having a housing, an electroacoustic transducer disposed in the housing, and a pair of joining portions, and the pair of joining portions being oppositely formed on the housing; and a pair of wearing headbands, each of the wearing headbands having two ends, each end of the wearing headband having a fixing piece, wherein the two fixing pieces of each of the wearing headbands are dismountably connected with one of the joining portions of each of the speaker modules, and the pair of speaker modules are oppositely arranged between the pair of the wearing headbands to form an annular structure;

wherein each of the joining portions is formed concavely in the housing along a tangential direction on a periphery of the housing, and each of the joining portions has a pair of joining openings, the pair of joining openings are on the same straight line; wherein the fixing piece has a pair of pins, and an end of the wearing headband is substantially U-shaped, the pair of pins are on the same straight line and located separately at the end of the wearing headband.

8. The annular headphone as claimed in claim 7, wherein the wearing headband has resilience.

9. The annular headphone as claimed in claim 7, wherein the wearing headband has an adjustable-length element used to adjust a length of the wearing headband.

10. The annular headphone as claimed in claim 7, wherein the wearing headband has a cable fixer to fixedly connect a cable of the pair of speaker modules, and the cable is dismountably assembled with the wearing headband.

11. An annular headphone, comprising:

a pair of speaker modules, each of the speaker modules having a housing, an electroacoustic transducer disposed in the housing, and a pair of joining portions, and the pair of joining portions being oppositely formed on the housing; and a pair of wearing headbands, each of the wearing headbands having two ends, each end of the wearing headband having a fixing piece, wherein the two fixing pieces of each of the wearing headbands are dismountably connected with one of the joining portions of each of the speaker modules, and the pair of speaker modules are oppositely arranged between the pair of the wearing headbands to form an annular structure;

wherein the joining portion of the speaker module is protruded from the housing and is formed with a through slot, and the fixing piece of the wearing headband is stripe-shaped passing through the through slot to connect with the wearing headband.

12. The annular headphone as claimed in claim 11, wherein the wearing headband has resilience.

13. The annular headphone as claimed in claim 11, wherein the wearing headband has an adjustable-length element used to adjust a length of the wearing headband.

14. The annular headphone as claimed in claim 11, wherein the wearing headband has a cable fixer to fixedly connect a cable of the pair of speaker modules, and the cable is dismountably assembled with the wearing headband.

15. The annular headphone as claimed in claim 11, wherein an inner side of the fixing piece of the wearing headband passing through the through slot is formed with an attaching element, so as to be fixed to the joining portion in a folded manner.

* * * * *